United States Patent [19]

Baron et al.

[11] 4,047,901

[45] Sept. 13, 1977

[54] FEEDER FOR COAL-GASIFICATION REACTOR

[75] Inventors: Gerhard Baron, Hofheim; Herbert Bierbach, Frankfurt am Main; Carl Hafke, Frankfurt am Main; Karlheinz Zolzer, Frankfurt am Main, all of Germany

[73] Assignee: Metallgesellschaft Aktiengesellschaft, Frankfurt am Main, Germany

[21] Appl. No.: 714,550

[22] Filed: Aug. 13, 1976

[30] Foreign Application Priority Data

Sept. 17, 1975 Germany ..... 2541356

[51] Int. Cl.[2] ..... C10J 3/30

[52] U.S. Cl. ..... 48/86 R; 48/77; 202/262; 214/17 B; 222/218

[58] Field of Search ..... 48/86 R, 77, 76, 101, 48/210; 201/6, 24; 202/262; 214/17 A, 17 B, 17 C; 222/194, 410, 218

[56] References Cited

U.S. PATENT DOCUMENTS

| | | | |
|---|---|---|---|
| 322,605 | 7/1885 | Hodgkinson | 48/86 R |
| 1,412,118 | 4/1922 | Johnston | 48/86 R |
| 2,143,987 | 1/1939 | Koller | 48/86 R |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

A device for feeding granular and dust coal to a coal-gasifying reactor which operates under a pressure of 5 to 150 bars. A stationary housing is connected to the coal inlet of the reactor and a lock chamber member is rotatedly mounted therein. The lock chamber member is movable between coal-receiving position and a coal-discharging position. The lock chamber member has at least one chamber which is open only at one end and contains a displacing device which extends approximately to the entrance of the chamber. The displacing device substantially prevents an ingress of product gas into the chamber when in the discharge position.

4 Claims, 3 Drawing Figures

FEEDER FOR COAL-GASIFICATION REACTOR

BACKGROUND

This invention relates to a feeder for feeding granular and dust coal to a coal-gasifying reactor operating under a pressure of 5 to 150 bars, comprising a stationary housing, which is connected to the coal inlet of the reactor and in which a lock chamber member is rotatably mounted, which is movable between a coal-receiving position and a coal-discharging position.

Known feeders for gasifying reactors consist either of stationary lock chamber containers, which are adapted to be charged and discharged, or of rotary star wheel feeders, such as are apparent from U.S. Pat. Nos. 1,412,118 and 1,814,787. These feeders are satisfactory in operation during the gasification of coal under approximately atmospheric pressure. During a gasification process under superatmospheric pressure product gas is received by the emptied volume of the feeder. This represents an undesired and disturbing loss. This loss of product gas increases as the gasification pressure rises.

SUMMARY

This invention provides a feeder of the kind defined above which is simple in structure and can easily be controlled and which prevents also a loss of product gas in disturbing quantities as the coal is fed into the reactor.

This is accomplished according to the invention in that the lock chamber member comprises at least one chamber which is open only at one end and contains a displacing device, which extends approximately to the entrance of the chamber and which in the discharge position substantially prevents an ingress of product gas into the chamber. The displacing device is movable between a position for discharging the coal to be fed into the reactor and a position for receiving said coal and in the discharge position seals the empty volume of the chamber against the gas pressure in the reactor. Any small gas losses, which may be due, e.g., to the clearance between the lock chamber member and the associated housing, will not be of practical significance.

A preferred further feature of the displacing device resides in that it consists substantially of a head member and a plurality of members which can be pushed one into the other so that the device can easily be extended and retracted. The head member of the device is designed to be a virtually gastight fit in the opening in the discharge position. The displacing device is suitably hydraulically operated.

A lock chamber member may comprise a plurality of chambers and associated displacing devices and these chambers may be filled and discharged into the reactor simultaneously or in a certain sequence. For instance, it may be suitable to provide a lock chamber member with two chambers, which are spaced 180° apart and operate in phase opposition during the rotation of the lock chamber member.

DESCRIPTION OF THE DRAWING

Illustrative embodiments of the feeder will be explained with reference to the drawing, in which.

DESCRIPTION

Figure 1:
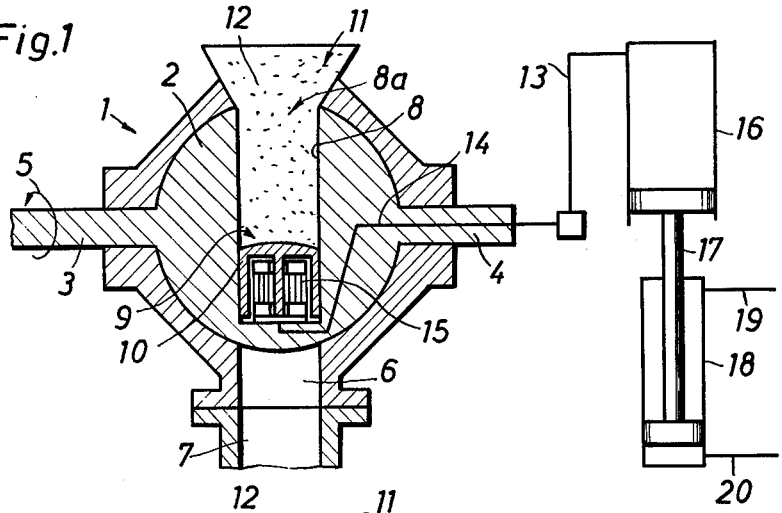
FIG. 1 is a longitudinal sectional view showing the feeder in the receiving position.
Figure 2:
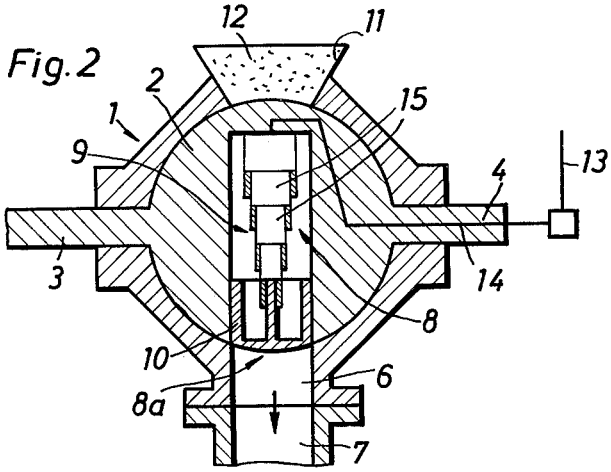
FIG. 2 shows the feeder of FIG. 1 in the discharge position.

The feeder shown in FIGS. 1 and 2 comprises a stationary housing, in which a substantially spherical lock chamber member 2 is fitted. The lock chamber member is rotatably mounted in the housing 1 by means of trunnions 3 and 4. Drive means, which are not shown and consist, e.g., of an electric motor, impart to the lock chamber member a rotation indicated by the arrow 5.

The housing 1 is secured at its outlet opening 6 to the inlet 7 of a reactor, known per se, for the pressure gasification of coal. Disintegrated or dust coal is gasified in the reactor in the presence of oxygen and water vapor and/or carbon dioxide under a pressure of 5 to 150 bars, preferably 10 to 80 bars. The product gas produced in the reactor would escape outwardly through the inlet unless additional measures are adopted. In addition to water vapor this product gas contains mainly carbon oxides, methane and tar vapors and it is at a temperature of about 500° to 800° C. Details of the pressure gasification and the associated reactors are known, e.g., from U.S. Pat. Nos. 3,937,620; 3,930,811; 3,902,872; and 3,951,616.

The feeder according to the invention serves to feed granular or dust coal into the reactor and prevents an escape of product gas from the reactor during the feeding of the coal. The spherical lock chamber member 2 has a cylindrical chamber 8, which is open only at one end. A displacing device 9 is secured in such a manner to the closed end of the cylindrical chamber 8 that the head member 10 of the device can be retracted and extended. The displacing device is diagrammatically shown in longitudinal section in FIG. 1.

When the feeder is in its receiving position, shown in FIG. 1, the displacing device 9 is retracted so that the chamber 8 can be filled with coal 12 through its inlet end 8a from the coal hopper 11. The coal may be coarse-grained coal having a particle size of 80 to 3 mm, or fine-grained coal having an upper particle size limit of about 3 mm, or dust coal.

As is apparent from FIG. 1, the substantially spherical lock chamber member 2 fitted in the housing 1 seals the pressure gasification reactor toward the outside so that product gas cannot escape outwardly in appreciable quantities through the feeder. Additional seals may be provided at suitable locations between the lock chamber member and the housing and have been omitted in the drawing for the sake of clearness.

To discharge the coal from the coal-filled chamber 8 into the inlet 7 of the pressure gasification reactor, the lock chamber member 2 is first rotated through 180° about its trunnions 3 and 4 so that the inlet end **8*a* of the chamber 8 is moved toward the outlet opening 6 of the housing. When this discharge position has been reached, see FIG. 2, the coal falls through the inlet 7 into the pressure gasification reactor. Due to the equalization of pressure with the interior of the reactor, the chamber 8 is filled with product gas of the coal gasification. The displacing device 9 having a head member 10 which is a gas-tight fit in the chamber 8 is extended so that said product gas is displaced out of the chamber 8 and the inlet end of the chamber is sealed. The extended displacing device is shown in elevation in FIG. 2 except for the head member 10, which is shown in longitudinal section. The lock chamber member 2 with the extended displacing device 9 is then rotated once more through 180° so that the chamber 8 assumes the receiving position shown in FIG. 1.** The displacing device is subsequently retracted and the chamber is filled once more with coal.

In the example shown on the drawing, the displacing mechanism 9 is hydraulically moved. For this purpose, hydraulic fluid is fed into and withdrawn from the displacing device 9 through conduits 13 and 14. The device 9 consists of a plurality of telescopic tubes 15, which form a stem that can be extended and retracted and carry the sealing head 10. The hydraulic fluid in conduits 13 and 14 consists preferably of an incombustible liquid, such as water, so that the fluid which contacts the gasification process in case of leaks in the lock chamber member 2 is innocuous for the coal gasification. The hydraulic fluid, which may contain some lubricant, is stored in a pressure cylinder 16 connected by a piston rod 17 to another pressure cylinder 18, in which oil is used as a hydraulic fluid which is fed and withdrawn through pressure conduits 19 and 20. The interconnected pressure cylinder 16 prevents an ingress of oil into conduit 14 and, in case of a defect, from conduit 14 into the pressure gasification reactor so that the risk of a deflagration or even explosion due to an ingress of oil into the reactor is avoided.

Figure 3:
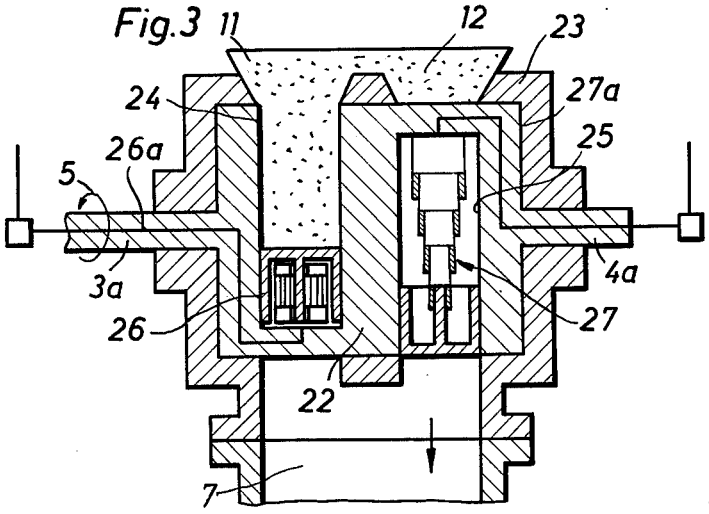
FIG. 3 is a longitudinal sectional view showing a feeder having two chambers.

FIG. 3 shows a feeder which has a cylindrical lock chamber member 22, which is fitted in a housing 23 and has two mutually oppositely directed chambers 24 and 25. The chambers 24 and 25 operate in phase oppositon. When one chamber (Chamber 24 in FIG. 3) is filled with coal, the other chamber (Chamber 25 in FIG. 3) is simultaneously discharged. Each chamber contains a displacing device 26 or 27. The displacing device 26 of the chamber 24 in receiving position is retracted and the displacing device 27 in chamber 25 is extended at the same time so that product gas from the reactor cannot enter the volume from which coal has been removed. The displacing devices 26 and 27 are hydraulically controlled through conduits 26*a* and 27*a.*

When the chamber 24 has been filled with coal and the chamber 25 has been completely emptied, the cylindrical lock chamber member 22 is rotated through 180° about its trunnions 3a and 4a so that the filled chamber can be emptied and the emptied chamber can be filled with coal once more, as has been explained with reference to FIGS. 1 and 2. It is apparent that more than two chambers may be provided in a lock chamber member and that the chambers need not extend parallel in mutually opposite directions.

What is claimed is:

1. Device for feeding granular and dust coal to a coal-gasifying reactor operating under a pressure of 5 to 150 bars comprising stationary housing means connected to the coal inlet of the reactor in which a lock member is rotatably mounted and movable between a coal-receiving position and coal-discharging position, said lock member having at least one chamber which is open only at one end and containing displacing means which extends approximately to the entrance of the chamber, said displacing means consisting of a plurality of telescopic tubes which form a stem that extends and retracts and carries a sealing head within the chamber, thereby substantially preventing an ingress of product gas into the chamber when in the discharge position.

2. Device of claim 1 wherein the displacing means is hydraulically movable.

3. Device of claim 2 wherein the hydraulic fluid acting directly on the displacing device is mainly an incombustible liquid.

4. Device of claim 1 wherein the lock member has two chambers spaced 180° apart and associated displacing means.

* * * * *